US006433664B1

(12) United States Patent
Ishii et al.

(10) Patent No.: US 6,433,664 B1
(45) Date of Patent: Aug. 13, 2002

(54) COIL

(75) Inventors: Hideo Ishii, Minoo; Toshikazu Fujiyoshi; Masao Katooka, both of Kawanishi, all of (JP)

(73) Assignee: Sansha Electric Manufacturing Company, Limited, Osaka (JP)

( * ) Notice: Subject to any disclaimer, the term of this patent is extended or adjusted under 35 U.S.C. 154(b) by 0 days.

(21) Appl. No.: 09/655,898

(22) Filed: Sep. 6, 2000

(30) Foreign Application Priority Data

Sep. 10, 1999 (JP) ..... 11-256985

(51) Int. Cl.[7] ..... H01F 27/30
(52) U.S. Cl. ..... 336/185; 336/199; 336/207
(58) Field of Search ..... 336/206, 221, 336/73, 185, 208, 207, 199

(56) References Cited

FOREIGN PATENT DOCUMENTS

| | | | | |
|---|---|---|---|---|
| JP | 51-37951 A | | 9/1976 | |
| JP | 61-234512 | * | 10/1986 | |
| JP | 406112055 A0 | * | 4/1994 | ..... 336/206 |

* cited by examiner

*Primary Examiner*—Lincoln Donovan
*Assistant Examiner*—Tuyen T. Nguyen
(74) *Attorney, Agent, or Firm*—Duane Morris LLP

(57) ABSTRACT

A conductor is wound around a magnetic core to form a plurality of conductor turns. The conductor turns are spaced from one another by a substantially equal spacing d. An insulating layer is disposed between the conductor turns and the magnetic core. An insulating member is wound around the magnetic core in such a manner as to be located in the spaces between and in contact with adjacent ones of the conductor turns.

2 Claims, 2 Drawing Sheets

COIL

This invention relates to a coil, and, more particularly, to a coil wound on a magnetic core for use in a transformer or a reactor.

BACKGROUND OF THE INVENTION

Usually, such coils are formed by winding conductors edgewise. The conductor used for such an edgewise-wound coil has a rectangular transverse cross-section and wound on a magnetic core with its longer sides of the rectangular cross-section placed perpendicular to the surface of the core. Thus, edgewise-wound coils can provide a reduced size transformers or reactors. An example of such prior art edgewise-wound coil is shown in FIG. 1.

This coil includes a magnetic core 2 with an insulating layer 4 disposed on an outer surface of the core 2. A conductor 6 is wound on the insulating layer 4. The conductor 6 has a rectangular transverse cross-section and is wound on the core 2 with the longer sides of the rectangular cross-section kept perpendicular to the outer surface of the core 2. A distance d between adjacent conductor turns is small, e.g. 2 mm.

In order to prevent adjacent conductor turns from contacting with each other, an insulating spacer 8 having a comb-shaped cross-section is used, with a spiral groove 8*a* formed therein fitted over the conductor 6 to hold the respective conductor turns in place. The distance between adjacent groove turns is equal to the distance d between adjacent conductor turns. The width of the groove 8*a* is equal to the dimension of the short sides of the cross-section of the conductor 6.

Alternatively, a spacer 10 like the one shown in FIG. 2 may be used. The spacer 10 is disposed on the magnetic core 2. A spiral groove 10*a* is formed in the spacer 10. The groove 10*a* has a width equal to the dimension of the shorter sides of the cross-section of the conductor 6. The distance between adjacent turns of the groove 10*a* is equal to the distance between adjacent conductor turns. The conductor 6 is wound in such a manner that respective conductor turns are fitted into respective groove turns, whereby the respective conductor turns are kept spaced from each other.

The width of the groove 8*a* or 10*a* of the spacer 8 or 10 of the above-described prior art coil must be equal to the length of the short sides of the cross-section of the conductor 6. Also, the distance between adjacent turns of the groove 8*a* or 10*a* must be equal to the distance between adjacent ones of the turns of the conductor 6. In order to further down-size transformers, the distance between adjacent conductor turns may have to be reduced, but it is difficult to manufacture a spacer with a smaller distance between adjacent groove turns. When a spacer with a comb-shaped cross-section is used for a smaller conductor turn spacing winding, teeth between adjacent groove turns may be broken. These problems are hindrance to the down-sizing of transformers. The same problems are encountered not only in down-sizing transformers but also in down-sizing of reactors. In other words, the use of edgewise-wound winding cannot always sufficiently down-size transformers and reactors.

An object of the present invention is to provide a configuration of coils which enables down-sizing of coils by reducing the spacing between adjacent coil conductor turns, while maintaining insulation between conductor turns.

SUMMARY OF THE INVENTION

According to the present invention, a coil is provided, which may be used as part of, for example, a transformer or a reactor. The coil includes a magnetic core and a winding disposed on the core. The magnetic core may have one of various shapes, such as a rectangular shape, a U-shape and a ring-shape. The winding is formed by winding a conductor on the magnetic core to form a plurality of conductor turns. The conductor turns are substantially equally spaced from each other on the core. Either coated or naked conductor can be used. An insulating layer may be disposed between the magnetic core and the conductor. The insulating layer may cover the entire outer surface of the core, or it may cover only part of the outer surface of the core. In case a rectangular magnetic core is used, the insulating layer may be formed to cover only the four corner portions.

An insulating member is wound on the magnetic core in a plurality of turns so that the insulating member may be placed in each of the spaces between adjacent conductor turns. Each turn of the insulating member is in contact with the conductor turns on the opposite sides. After being wound on the core, the insulating member may be hardened.

The insulating member may be deformable into a flat shape by the conductor turns with which it contacts. For example, the insulating member may have a circular transverse cross-section with a diameter larger than the spacing between adjacent conductor turns, or it may have a rectangular or square transverse cross-section with a larger dimension in the direction of the spacing of the conductor turns than the conductor turn spacing. In either case, when the insulating member comes into contact with the conductor turns, it is flattened. Accordingly, it eliminates the need for adjusting beforehand the diameter or the dimensions of the insulating member to the spacing between the conductor turns.

The conductor may have a rectangular transverse cross-section with the longer sides placed substantially perpendicular to the outer surface of the magnetic core. In other words, the conductor may be wound edgewise on the core. The edgewise winding of a conductor enables down-sizing of a coil, as described previously. Accordingly, when it is employed in the present invention, further down-sizing can be realized.

The conductor and the insulating member may be wound together around the magnetic core. According to the prior art described with reference to FIG. 1, in which the spacer 8 is used to hold the conductor 6 in place, separate steps are required for winding the conductor 6 around the core and for placing the spacer 8 with respect to the conductor turns, which is a cause for a low working efficiency. In contrast, winding the conductor and insulating member together can increase the working efficiency.

DETAILED DESCRIPTION OF THE INVENTION

Figure 1:
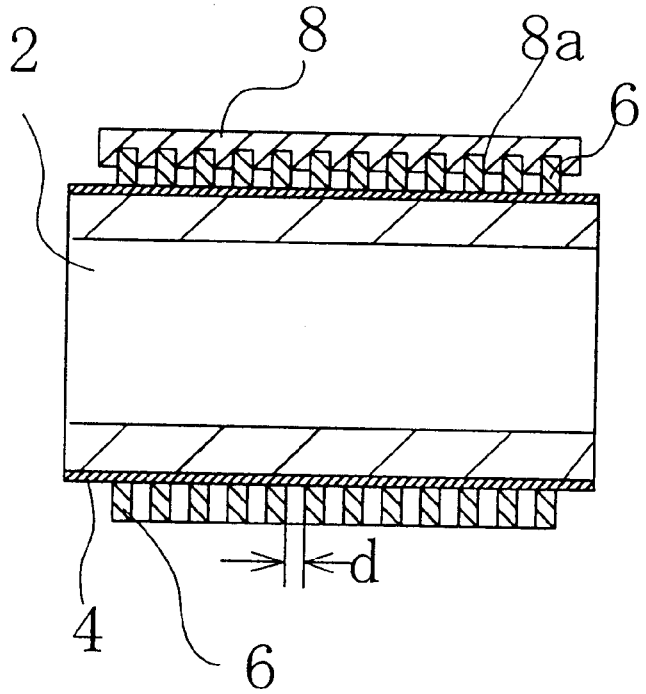
FIG.1 Prior Art
FIG. 1 is a longitudinal cross-sectional view of an example of prior art coils.
Figure 2:
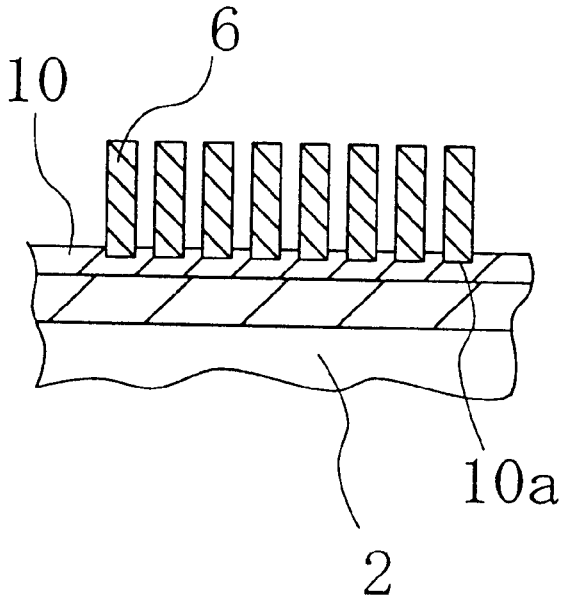
FIG.2 Prior Art
FIG. 2 is a partial, longitudinal cross-sectional view of another example of prior art coils.
Figure 3:
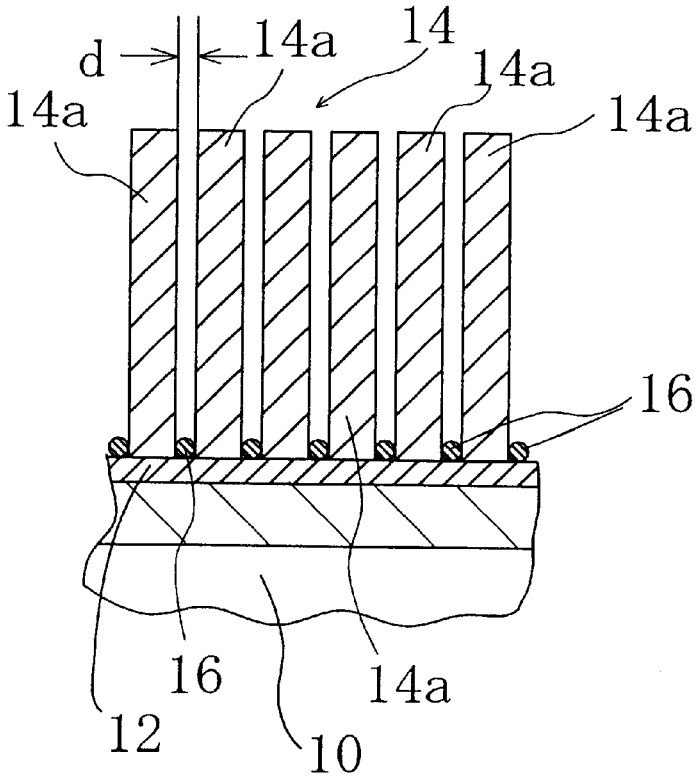
FIG. 3 is a partial, longitudinal cross-sectional view of a coil according to a first embodiment of the present invention.

A coil according to one embodiment of the present invention may be used, for example, as a primary or secondary winding of a transformer, and includes, as shown in FIG. 3, a magnetic core 10. The core 10 is formed of a laminate of thin steel sheets and has a rectangular transverse cross-section, for example. The cross-sectional shape of the magnetic core 10 is not limited to a rectangle, but it may be another shape, e.g. U-shape or E-shape. Alternatively, the core may be ring-shaped.

An insulating material is disposed over the outer surface of the magnetic core 10. For example, an insulating layer 12 is formed on the entire outer surface of the core 10. It may be formed on limited areas. For example, when the magnetic core 10 is rectangular, the insulating layer 12 may be disposed only those portions around the four corners.

A conductor 14 is wound on the insulating layer 12 to form a plurality of conductor turns 14*a*. The conductor 14 may be a naked conductor or a coated conductor. The conductor 14 may be a flat conductor having a rectangular transverse cross-section. The longer sides of the cross-section may have a length, for example, of 10 mm, and the shorter sides are, for example, 1.4 mm long. The conductor turns 14*a* are wound with the longer sides disposed substantially perpendicular to the magnetic core 10. In other words, the conductor 14 are wound edgewise, which makes it possible to form a smaller size coil. The conductor turns 14*a* are arranged along the length of the core 10, with a predetermined spacing d between adjacent conductor turns 14*a*. The spacing d may be, for example, 0.6 mm.

An insulating member 16 is wound around the core 10 in such a manner that each turn of the insulating member 16 may be placed in each of the spaces between adjacent conductor turns 14*a*.

The insulating member 16 may be formed by processing, for example, aromatic polyamide flocks and fibrid, with a paper machine into a paper structure and is deformable. The insulating member 16 is placed in the spaces between adjacent ones of the conductor turns 14*a* and keeps the conductor turns 14*a* separated from each other by the distance d.

The insulating member 16, which acts as a spacer, is not fitted into the spaces between adjacent conductor turns 14*a*, but it is wound around the core 10. Accordingly, it can be located between adjacent conductor turns to thereby keep them separated even when a smaller conductor turn spacing is employed. Therefore, a smaller coil can be fabricated.

The insulating member 16 shown in FIG. 3 has a generally circular cross-section, but it may be a tape having a cross-section with one of polygonal shapes, e.g. rectangular or square shape.

In the illustrated example, the insulating member 16 is wound in a single layer, but a stack of two or more layers of insulating member 16 may be used.

The insulating member 16 may be porous. Also, the cross-section of the insulating member need not be perfectly circular, but it may be elliptic, for example.

The insulating member 16 is wound around the magnetic core 10 together with the conductor 14. After they are wound on the core 10, the insulating member 16 and the conductor 14 are coated with insulating varnish. The varnish solidifies, so that the insulating member 16 and the conductor 14 are fixed, maintaining the spacing d between adjacent ones of the conductor turns 14*a*.

Figure 4:
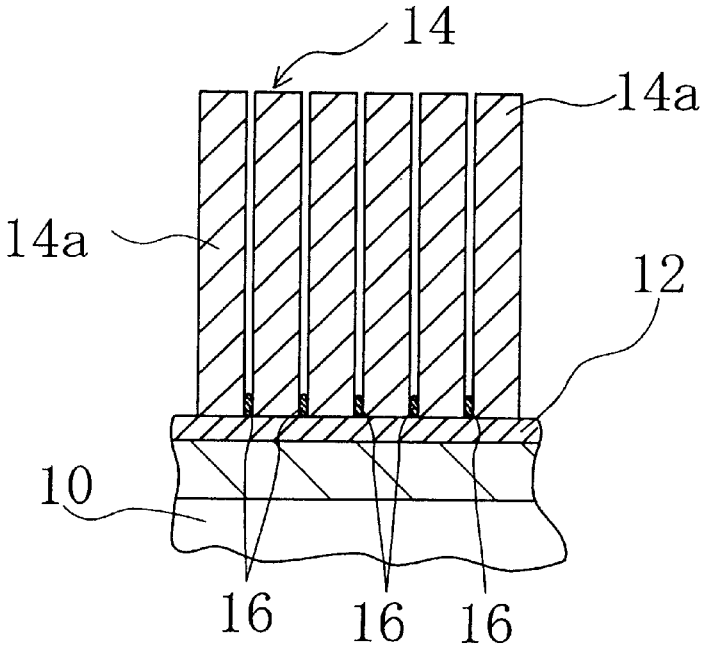
FIG. 4 is a partial, longitudinal cross-sectional view of the coil of FIG. 3, having a further reduced spacing between adjacent conductor turns.

The insulating member 16 is made of paper-like material and, therefore, can be flattened along the longer sides of the cross-section of the conductor 14. Accordingly, if a further reduced conductor turn spacing is required, the insulating member 16 can flatten and prevent adjacent conductor turns 14*a* from contacting each other, as shown in FIG. 4. Thus, a coil of a further reduced size can be manufactured.

The present invention has been described by means of a coil used for a transformer, but it may be embodied in other coils, such as reactors.

Also, the insulating layer 12 may be eliminated when a coated conductor is used as the conductor 14.

What is claimed is:

1. A coil comprising:

a magnetic core;

a conductor wound edgewise around said magnetic core to form a plurality of conductor turns with substantially the same spacing disposed between adjacent conductor turns, said conductor having a rectangular transverse cross-section, and having longer sides thereof disposed substantially perpendicular to an outer surface of said magnetic core; and a deformable insulating member disposed between adjacent ones of said conductor turns, said insulating member being compressed by said adjacent ones of said conductor turns and flattened.

2. The coil according to claim 1 wherein said conductor and said insulating member are wound together around said magnetic core.

* * * * *